United States Patent [19]

Buttner

[11] 4,331,191

[45] May 25, 1982

[54] WOODWORKING MACHINE

[75] Inventor: Kurt Buttner, Oberkochen, Fed. Rep. of Germany

[73] Assignee: Okoma Maschinenfabrik GmbH, Oberkochen, Fed. Rep. of Germany

[21] Appl. No.: 138,399

[22] Filed: Apr. 8, 1980

[30] Foreign Application Priority Data

Apr. 9, 1979 [DE] Fed. Rep. of Germany ..... 2914355

[51] Int. Cl.[3] ..... B27C 9/04

[52] U.S. Cl. ..... 144/3 R; 144/84; 144/134 A; 144/198 R; 144/204; 144/326 R

[58] Field of Search ..... 144/3 R, 19, 82, 84, 144/198 R, 203, 204, 326 R, 134 R, 134 A

[56] References Cited

U.S. PATENT DOCUMENTS 1,756,296 4/1930 Madsen ..... 144/203 X 3,008,501 11/1961 Hammer ..... 144/3 R X 3,306,324 2/1967 Lillywhite ..... 144/204 X

*Primary Examiner*—W. D. Bray

*Attorney, Agent, or Firm*—William A. Drucker

[57] ABSTRACT

A woodworking machine for window frames has at least one vertical tenoning spindle, at least one further spindle for longitudinal profiling disposed diagonally with respect to the first spindle, and a further tenoning spindle fitted at the opposite side of the profiling assembly to that having the first tenoning spindle, a work table for the profiling spindle, and two sliding tables respectively for the first and second tenoning spindles and aligned with the work table of the profiling spindle. The improvement is that at least two first tenoning spindles are fitted one behind the other at an input end of the machine and are followed, in the direction of passage of a workpiece through the machine, by at least two profiling spindles, and then at least two second tenoning spindles.

3 Claims, 1 Drawing Figure

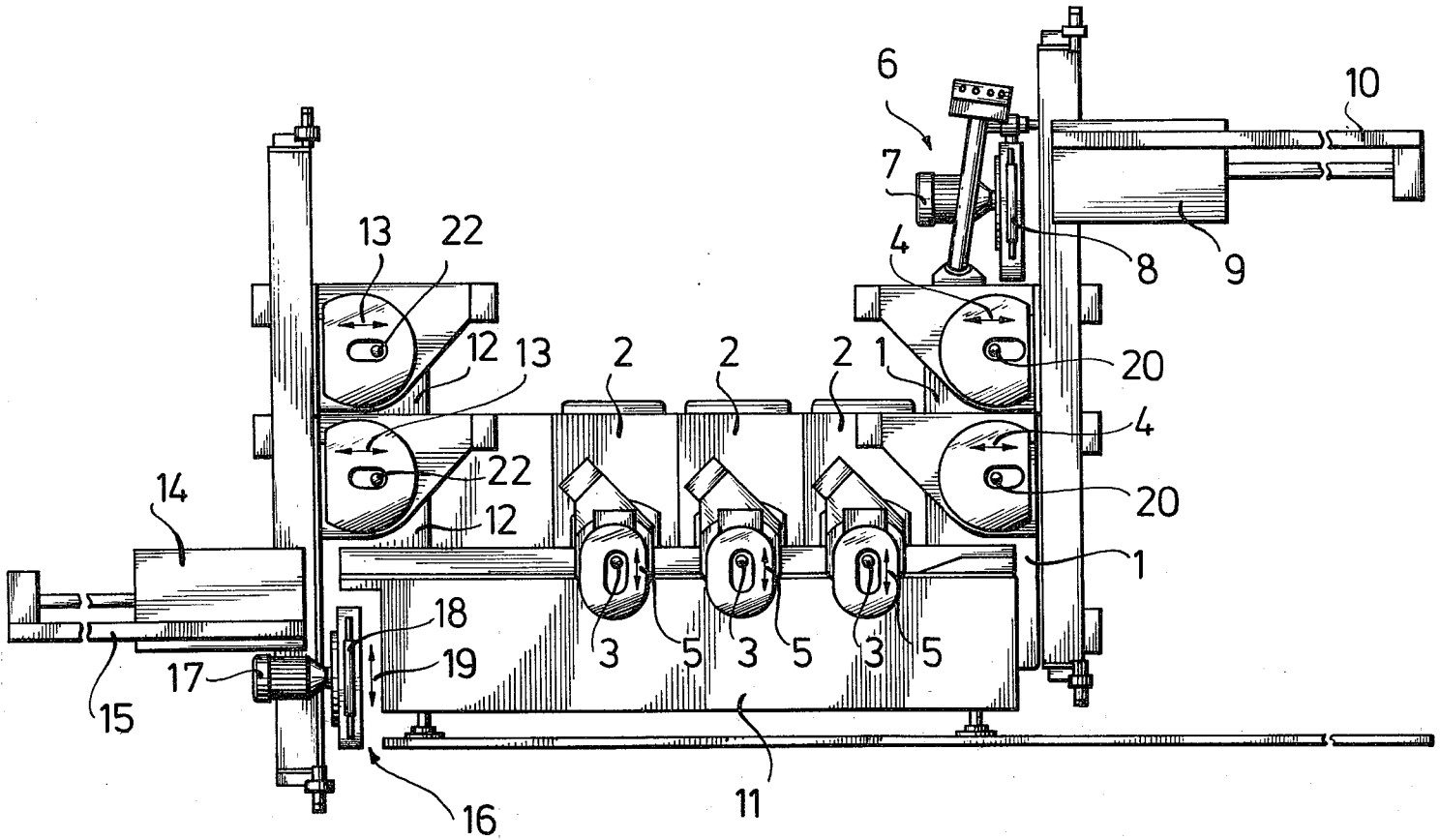
10
9
8
20
4
20
1
6
7
4
1
2
5
3
2
5
3
2
5
3
11
13
22
12
13
22
12
18
19
16
14
17
15

WOODWORKING MACHINE

BACKGROUND OF THE INVENTION

The invention relates to a woodworking machine for the tenoning and longitudinal profiling of timber frames, especially window frames, in which provision is made for at least one first vertical spindle, with tenoning tools, located diagonally to at least one further spindle with tools for longitudinal profiling, a further tenoning spindle being fitted on the opposite side of the assembly containing the longitudinal profiling spindle, and two sliding tables allocated to the tenoning spindles and aligned with the work table of the longitudinal profiling spindle, being provided.

THE PRIOR ART

A machine disclosed in German Patent Specification No. 2138137, in which the present Applicant is named as inventor, makes it possible, in one continuous operation, to form tenons and mortises first at one end of a window frame, after which the latter is moved longitudinally past the longitudinal profiling spindle so that it may then be moved transversely past the second tenoning spindle in order to form the tenons and mortises at the opposite end.

The disadvantage of this known layout is that it permits the manufacture of only certain window frames of certain cross-sections and/or profiles. If other cross-sections are required and also if different tenons and mortises are necessary, the tools in all three spindles have to be changed. This applies even to ordinary windows in cases where the wood comprising a single window is provided with several tenons and mortises, because a threefold tool change is then required to produce a single window.

OBJECTS OF THE INVENTION

Accordingly the object of the invention is to provide a woodworking machine of the type described above with which ordinary windows can be manufactured without any change of tools.

SUMMARY OF THE INVENTION

In accordance with the invention this problem is solved by fitting at least two tenoning spindles one behind the other at the input end of the machine, which are followed by at least two longitudinal profiling spindles and at least two additional tenoning spindles.

This arrangement means that, as a result of the sequence of at least two sets of tools on the two interrelated spindles, multistage profiles, together with their appropriate tenon and mortise joints, can be made in a single operation without a change of tools. It follows that, with the layout according to the invention, any idle time of the machine can be completely eliminated. The absence of tool changes removes the possibility of sources of error connected therewith, such as can arise from setting-up mistakes and the like.

Unlike another prior art layout, in which two tenoning spindles are fitted after at least two longitudinal spindles, the arrangement according to the invention has the advantage that the window frame, without having to be turned, passes through the machine in a single operation, emerging as the finished product. With said prior art layout, the tenons and mortises at the one end of the window frame are first made, after which the sliding table has to be moved back and the window frame turned so that, by renewed movement of the sliding table forwards, the tenons and mortises can be provided at the other end. Only then can the window frames be passed to the longitudinal profiling spindles. In the present invention, in contrast, the tenons and mortises of the second end are not provided until after longitudinal profiling, in one continuous operation, and so idle time involved in the backward movement of the sliding table is saved.

The tenoning spindles and also the longitudinal profiling spindles can be movably fitted at right angles to the direction of advance so that, for certain processes, the tools can if required be engaged or disengaged. Furthermore, the tenoning spindles and also the longitudinal profiling spindles can be provided with two or more sets of tools located one above the other and be adjustable for height in order to be able to bring the sets of tools located one above the other into use as required, thereby making it possible to produce different profiles with a single setting of the tools.

BRIEF DESCRIPTION OF THE DRAWING

An embodiment of the invention is described in detail below with reference to the drawing. The drawing has a single FIGURE which is a diagrammatic plan view of the machine.

DESCRIPTION OF THE PREFERRED EMBODIMENT

The drawing shows a woodworking machine for tenoning and longitudinal profiling. The machine has two assemblies 1, each with a tenoning spindle 20, and disposed in a row normal thereto three assemblies 2 each equipped with longitudinal profiling spindles 3. The tenoning spindles 20 can be moved in the direction of the arrow 4 and the longitudinal profiling spindles 3 in the direction of the arrow 5 to allow engagement and disengagement of the tools (not shown) which can be fixed to the spindles. In addition, the tenoning spindles 20 are adjustable for height.

A cross-cut device 6, consisting of a saw 8 driven by a motor 7, is fitted to the tenoning spindles 20 with the plane of its blade at right angles to the row of assemblies 2 of the longitudinal profiling spindles 3. In addition, provision is made for a sliding table 9 fitted with a pusher bar 10, by means of which the window frame is moved past the tenoning spindles 20. The frame is then fed onto the table 11 and moved past the longitudinal profiling spindles 3. The surface of the sliding table 9 is aligned with the surface of the worktable 11. The table 9 is motor driven to and fro parallel to a line joining the axes of rotation of the tenoning spindles 20.

Similarly, at right angles to the series of longitudinal profiling spindles 3, and thus to the longitudinal direction of the work table 11, there are connected two further assemblies 12 fitted with additional tenoning spindles 22. These tenoning spindles 22 can also be moved in and out in the direction of the arrow 13, and are adjustable for height. These tenoning spindles are also provided with a sliding table 14, having a stop bar 15, the surface of which is also aligned with the surface of the work table 11 and thus also with the surface of the first sliding table 9. The table 14 is motor driven to and fro parallel to a line joining the axes of rotation of the tenoning spindles 22. In addition, provision is made for a cross-cut device 16, consisting of a motor 17 and a saw 18, which can travel in the direction of the arrow 19 normally to the row of longitudinal profiling spindles 3.

It follows that, from the very start, the tenoning spindles 20 and 22 and also the longitudinal profiling spindles 3 can be fitted with the tools required for the production of various tenon and mortise joints and of various cross-sectional profiles, only that or those tools being inserted and engaging with the workpiece which are necessary for the production of the required cross-sectional profile or for the required tenon and mortise arrangement. On the other hand, the layout in accordance with the invention enables the tools of several consecutive spindles to be engaged simultaneously, in order for example to enable ordinary windows and their tenon and mortise joints to be produced in a single operation.

To achieve this, the window frame is first led in a first direction past two tenoning spindles 20 by means of the sliding table 9, with the result that the first end of the window frame is machined, after which the window frame is transferred to the work table 11 and is fed in a second direction at right angles past the assemblies 3 and longitudinally profiled and finally is taken received on the sliding table 14, and moved in reverse along said first direction so that its other end is given tenons and mortises by the tenoning spindles 22. The cross-cutting in the area of the first end of the window frame, prior to tenoning, is effected by the saw 8 and the cross-cutting in the area of the second end of the window frame by the saw 18.

The complete manufacture of the window frame described above takes place in one continuous operation, without the need to turn the window frame and without the idle times due to withdrawal of a sliding table. In this way, it is possible for example for the sliding table 9 to have already returned to its initial position while longitudinal profiling is taking place, so that it can be accepting a new window frame which can be machined immediately after the previous frame.

I claim:

1. In a woodworking machine, for tenoning the ends and for longitudinally profiling the sides of rectangular wooden workpieces such as window frames, having:

(i) a support structure (ii) first rotatable spindle means mounted on said support structure and having cutter means thereon for tenoning, (iii) a first workpiece-supporting table movable relative to the support structure past said first spindle means in a first direction such that said cutter means forms tenoning along a first end of the workpiece, (iv) second rotatable spindle means mounted on said support structure and having cutter means thereon for longitudinal profiling, (v) a second workpiece-supporting table fixed stationarily on said support structure and on which said workpiece can be slidingly moved past said second spindle means in a second direction at right angles to said first direction for longitudinal profiling of a side of said workpiece, (vi) third rotatable spindle means mounted on said support structure and having cutter means for tenoning, and (vii) a third work-piece supporting table movable relative to the support structure past said third spindle means in the reverse of said first direction such that said third spindle cutter means forms tenoning along a second end of the workpiece, the improvement which consists in that, in combination:

(a) said first rotatable spindle means comprises at least two first spindles the axes of rotation of which are disposed in a row parallel to said first direction, (b) said second spindle means comprises at least two second spindles the axes of rotation of which are disposed in a row parallel to said second direction, and (c) said third spindle means comprises at least two third spindles the axes of rotation of which are arranged in a row parallel to said first direction.

2. A woodworking machine, as claimed in claim 1, wherein said first and third spindles are also movable normal to said first direction, and wherein said second spindles are also movable normal to said second direction.

3. A woodworking machine, as claimed in claim 1, wherein said first, second and third spindles are also movable parallel to their own axis.

* * * * *